US005813251A

United States Patent [19]

Voit

[11] Patent Number: 5,813,251

[45] **Date of Patent: *Sep. 29, 1998**

[54] PROCESS AND APPARATUS FOR LOW-TEMPERATURE SEPARATION OF AIR

[75] Inventor: Jürgen Voit, Schondorf, Germany

[73] Assignee: Linde Aktiengesellschaft, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 752,947

[22] Filed: Nov. 21, 1996

[30] Foreign Application Priority Data

Nov. 21, 1995 [DE] Germany ..... 195 43 395.5

[51] Int. Cl.[6] ..... F25J 3/00

[52] U.S. Cl. ..... 62/646; 62/647

[58] Field of Search ..... 62/646, 647

[56] References Cited

U.S. PATENT DOCUMENTS 4,507,134 3/1985 Tomisaka et al. ..... 62/646
4,704,148 11/1987 Kleinberg ..... 62/647
4,964,901 10/1990 Rhode ..... 62/13
5,590,544 1/1997 Corduan et al. ..... 62/656

FOREIGN PATENT DOCUMENTS 38 17 244 A1 11/1989 Germany .
40 30 749 A1 4/1992 Germany .
44 06 049 A1 9/1995 Germany .

*Primary Examiner*—Ronald C. Capossela
*Attorney, Agent, or Firm*—Millen, White, Zelano & Branigan, P.C.

[57] ABSTRACT

The process and the apparatus are used for low-temperature separation of air in a rectifying column system that has a preliminary separation column (10) and a low-pressure column (20). Feed air (1, 3) is introduced (4, 6, 7, 8, 41) into preliminary separation column (10) and is separated into a nitrogen-enriched overhead fraction and an oxygen-enriched bottom fraction. At least a portion (19) of the oxygen-enriched bottom fraction is introduced into the low-pressure column (20), in which liquid oxygen and gaseous nitrogen are produced. The pressure in preliminary separation column (10) is essentially equal to the pressure of low-pressure column (20). The reflux for the columns can be obtained by one or two cyclic processes operated with overhead gas (11, 23) from one or two columns (10, 20).

19 Claims, 1 Drawing Sheet

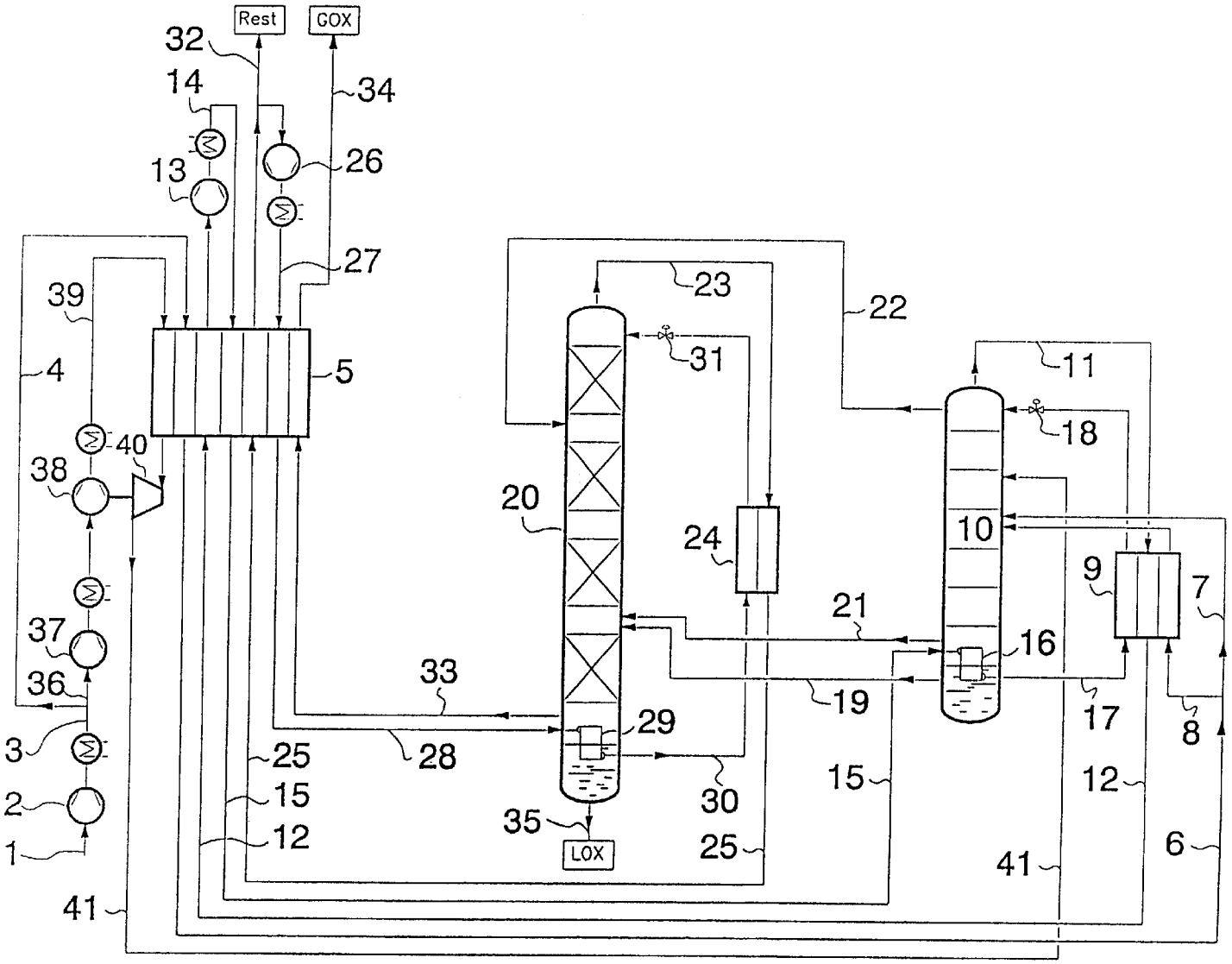
GOX
Rest
LOX

PROCESS AND APPARATUS FOR LOW-TEMPERATURE SEPARATION OF AIR

BACKGROUND OF THE INVENTION

This invention relates to a process and apparatus for the low-temperature separation of air in a rectifying column system that has a preliminary separation column and a low-pressure column, in which feed air is introduced into the preliminary separation column to produce a nitrogen-enriched fraction and an oxygen-enriched bottom fraction, and at least a portion of the oxygen-enriched bottom fraction is introduced into the low-pressure column to produce liquid oxygen and gaseous nitrogen. Understood as part of this invention is a process or apparatus that has at least two columns for nitrogen-oxygen separation. This includes systems in which the feed air is separated in three or more columns, and/or in which additional columns are provided, for example a raw argon column, for extracting other air components such as noble gases.

A two-column process of the above-mentioned type is known from the double-column system of DE-C-2854508. Reflux for both columns is produced in this process in a common condenser-evaporator, in which nitrogen-enriched top gas from the preliminary separation column is liquefied against evaporating oxygen from the bottom of the low-pressure column. This thermal coupling of both columns makes it necessary for the pressure in the preliminary separation to be sufficiently high so that the condensation temperature of the nitrogen at the top of this column exceeds that of the boiling oxygen in the bottom of the low-pressure column. Consequently, a considerable amount of energy is expended for the condensation of the feed air in the high pressure column.

SUMMARY OF THE INVENTION

An object of this invention is to provide a process and apparatus of the above-mentioned type that from an energy standpoint operates especially economically.

Upon further study of the specification and appended claims, further objects and advantages of this invention will become apparent to those skilled in the art.

These objects are achieved by having the pressure in the preliminary separation column be essentially equal to the pressure of the low-pressure column.

"Essentially equal" here means that the pressure difference between the pressure of both columns is less than about 0.5 bar, preferably less than about 0.1 bar. This is achieved, for example, by providing that the piping that connects both columns (for example the bottom liquid line from the preliminary separation column into the low-pressure column) contains no pressure-reducing devices such as, for example, expansion valves. Thus the pressure difference is due to only the frictional pressure drop along this piping (including standard fittings, e.g., elbows). Accordingly, the pressure difference is considerably less than with the above-described conventional double-column process.

In the invention, the low-pressure column is preferably operated at the lowest possible pressure. The latter is determined by the ultimate use of the top (overhead) product from the low-pressure column (after optionally passing through one or more heat exchangers). On the one hand, the top product can be removed from the process at essentially atmospheric pressure, i.e., a pressure that is about 0.15 bar to 0.35 bar higher than the pressure of the surrounding atmosphere. On the other hand, if this top product is fed as regeneration gas into for example an adsorption unit for the removal of $H_2O$ from incoming air a (e.g., a molecular sieve unit), the pressure of the low-pressure column must be sufficient to operate that device. The low-pressure column pressure can be, for example, 1.2 to 1.5 bar, preferably 1.3 to 1.4 bar.

With the process according to the invention, oxygen can be separated, for example, at a purity of, e.g., 80% by volume to 99.9% by volume. With a conventional pure nitrogen section added to the top of the low-pressure column, pure nitrogen can also be produced. Argon recovery is also possible by argon rectification placed downstream from the low-pressure column in a conventional manner (see, e.g., EP-B-377117). Likewise, other noble gases can be recovered by conventional processes.

The reflux for the columns is produced in the process according to the invention by heating at least a portion of the nitrogen-enriched top fraction from the preliminary separation column, compressing it, and feeding it back into the rectifying column system, in particular into the preliminary separation column where it is condensed by indirect heat exchange. The compression of the nitrogen-enriched top fraction occurs, for example, at about ambient temperature, and brings about a final pressure of, for example, 2.8 to 6.0 bar, preferably 3.0 to 5.0 bar. The amount of recycled nitrogen that is recompressed with respect to the preliminary separation column is—depending on the purity of the oxygen product—for example, 3% to 30%, preferably 10 to 20% by volume of the total amount of feed air (i.e., $Nm^3/h$, volume measured at 0° C. and 1 atmosphere absolute).

The indirect heat exchange used to liquefy the nitrogen-enriched top fraction is preferably performed against at least a portion of the oxygen-enriched bottom fraction which thereby evaporates. The top gas from the top of the preliminary separation column is thus used to heat the bottom of the preliminary separation column. The condenser-evaporator in which the indirect heat exchange occurs can be placed inside or outside the preliminary separation column.

Additionally or alternatively, the reflux liquid in the process according to the invention can be produced by heating at least a portion of the gaseous nitrogen from the low-pressure column, compressing it, liquefying it by indirect heat exchange and feeding it back into the rectifying column system, in particular into the low-pressure column. The compression of the gaseous nitrogen from the low pressure column is performed, for example at about ambient temperature, to a pressure of for example, 4.0 to 6.0 bar, preferably 4.5 to 5.0 bar. The amount of recycled recompressed nitrogen with respect to the low-pressure column—depending on the purity of the oxygen product—is, for example 30 to 90%, preferably 40 to 80% of the total amount of feed air (standard volume).

The indirect heat exchange to liquefy the gaseous nitrogen is preferably performed against at least a portion of the liquid oxygen from the low-pressure column, which thereby evaporates. The recycle fluid from the top of the low-pressure column is thus used for heating the bottoms of the low-pressure column. The condenser-evaporator in which the indirect heat exchange occurs can be placed inside or outside the low-pressure column.

Preferably the total quantity of the recycle fluid from each of the two columns is fed back into the corresponding column. But it is also possible that the liquefied top fraction from one column can be entirely or partially fed as reflux to the other column. The heating of the recompressed top fraction can be performed in both cases in a main heat exchanger against feed air that is to be cooled. Preferably the recompressed fraction is likewise again cooled in this main heat exchanger before liquefaction.

A portion of the compressed feed air can be expanded to produce energy to provide cold values for makeup heat exchange and insulation losses and optionally for product liquefaction. Here it is advantageous if the portion of the feed air to be expanded to produce energy is further compressed upstream of the energy-producing expansion. Preferably the energy produced by the energy-producing expansion is used for further compression of the portion of the feed air that is to be expanded to produce energy. The expansion machine, e.g., a turbine and booster can be mechanically connected for this purpose.

The invention relates further to an apparatus for the low-temperature separation of air comprising a rectifying column system having a preliminary separation column and a low-pressure column, a feed air conduit leading into said into preliminary separation column, a bottom fraction conduit connecting the preliminary separation column to said low-pressure column, wherein said bottom fraction conduit has no pressure-reducing devices.

As another aspect of the apparatus of the invention, there is provided a first recycle line connected to the upper section of the preliminary separation column, leading via a heat exchanger, to a compressor, and then through the liquefaction side of a first condenser-evaporator, back into the rectifying column system, especially into the preliminary separation column.

According to a further preferred modification, the evaporation side of the first condenser-evaporator is connected to the lower part of the preliminary separation column. By lower part is meant lower than the theoretical midpoint. For example, if the column has 71 theoretical plates, then the lower part would be below theoretical plate 36.

In a still further preferred embodiment of the invention, the apparatus further comprises a second recycle line connected to the upper section of the low pressure column, leading via a heat exchanger and compressor through the liquefaction side of a second condenser-evaporator back into the rectifying column system, especially into the low pressure column.

This second recycle line constitutes a preferred embodiment, with or without the first recycle line. Also, a further preferred modification comprises connecting the evaporation side of the second condenser-evaporator to the lower part of the low pressure column.

BRIEF DESCRIPTION OF THE DRAWING

The invention and other details of the invention are explained in more detail below based on the preferred embodiment schematically represented in the attached FIGURE.

DETAILED DESCRIPTION OF THE FIGURE

Feed air 1 is compressed in a main air compressor 2 to a pressure of, for example, 1.2 bar to 1.5 bar, preferably 1.3 bar to 1.4 bar, preferably at most about 1.35 bar. At least a portion of the compressed feed air 3 flows by a line 4 to a main heat exchanger 5, is cooled there against product streams and is fed, by lines 6 and 7, into a preliminary separation column 10 operating at a pressure of 1.1 to 1.4 bar, preferably 1.15 to 1.35 bar, at most preferably at most about 1.25 bar. A portion of the cooled air can also be fed by line 8 through a heat exchanger 9.

During rectification in preliminary separation column 10, the overhead gas becomes enriched in nitrogen and an oxygen-enriched liquid accumulates as the bottom fraction. The nitrogen-enriched top fraction 11 is heated in heat exchanger 9 and (via line 12) further in main heat exchanger 5 to about ambient temperature, compressed in a first recompressor 13 to a pressure of 2.8 to 5 bar, preferably 2.9 to 4 bar, at most preferably about 3.0 bar. The resultant compressed top fraction is conveyed by line 14 back to main heat exchanger 5 and, from its cold end, via line 15 to a first condenser-evaporator 16. There it is liquefied, at least partially, preferably completely or essentially completely, in indirect heat exchange with evaporating bottom liquid from the preliminary separation column. The condensate, via conduit 17—optionally after being subcooled in heat exchanger 9—is pressure reduced via pressure reducing valve 18 as it enters the preliminary separation column 10. The quantity of the cyclic process conveyed by recompressor 13 is about 10% of the total feed air (standard volume) in the embodiment. Condenser-evaporator 16, unlike the representation, can be placed outside the bottom of preliminary separation column 10.

Preferably all the bottom liquid of the preliminary separation column that is not evaporated in first condenser-evaporator 16 flows by line 19 into a low-pressure column 20, and specifically preferably several, e.g., 10 to 20, theoretical plates above the bottom. Additionally, vapor 21 from the bottom of the preliminary separation column is fed to the low-pressure column at about the same point.

A portion of the resultant condensate in line 17 in this first recycle circuit can be introduced directly or, by line 22, as represented in the drawing, indirectly into low-pressure column 20 operated at a pressure of 1.1 to 1.4 bar, preferably 1.15 to 1.25 bar, and at most preferably about 1.2 bar. The feed point is below the top, but above that of bottom fractions in conduits 19 and 21.

Additional reflux is produced from the top gas of low-pressure column 20 in a second recycle circuit. For this purpose, gaseous nitrogen 23 is withdrawn from the top of low-pressure column 20, optionally heated in a heat exchanger 24 and via line 25 heated further in main heat exchanger 5 to about ambient temperature, compressed in a second recompressor 26 to a pressure of 4 to 6 bar, preferably 4.5 to 5.0 bar, preferably at most about 4.7 bar. The resultant compressed gas is conveyed by line 27 back to main heat exchanger 5 and from its cold end via conduit 28 to a second condenser-evaporator 29. There it is liquefied at least partially, preferably completely or essentially completely, in indirect heat exchange with evaporating bottom liquid (oxygen) from the low-pressure column. The condensate—optionally after being subcooled in 24—is passed via conduit 30 through pressure reducing valve 31 as it enters the low-pressure column 20. A potion of the heated, gaseous nitrogen can be withdrawn via line 32 as residual gas or product before or after the recompression step. The quantity from the recycle circuit that is conveyed by recompressor 26 in the embodiment is 74% of the total feed air (standard volume). The condenser-evaporator 29, unlike the representation in the FIGURE, can alternatively be placed outside the bottom of low-pressure column 20.

Gaseous product oxygen 34 of a purity of, e.g., 80 to 99.9% by volume, preferably 90 to 99.5% by volume, is withdrawn by line 33 and likewise heated in main heat exchanger 5. The oxygen product or a portion thereof, if needed, can be withdrawn via line 25 in liquid form. To produce a high-pressure product, the oxygen withdrawn as a liquid can be brought under pressure and evaporated (internal recompression). If desired, a portion of the liquefied nitrogen can be removed as a liquid product before or after valve 31.

In the embodiment, a portion 36 (for example 10 to 60% by volume, preferably 45 to 55% by volume, at most preferably about 53% by volume) of the feed air is expanded to produce energy in an expansion machine 40, e.g., a turbine, and then is fed via conduit 4 to the preliminary separation column 10 at a point above the entry points of conduits 7 and 8 which carry the balance of the feed air. The air to be expanded to produce energy is further compressed in advance to a pressure of 1.5 to 4 bar, preferably 1.5 to 2.5 bar, at most preferably about 1.9 bar, and specifically by a booster 38 driven by expansion machine 40 and optionally by an additional, externally driven booster 37.

Downstream of each compressor 13, 26, 37, 38, the compressed fluid is cooled in indirect heat exchange with cooling water, as indicated by the coolers represented in the FIGURE. With multistage condensers, an intermediate cooling is preferably performed between two stages.

The cleaning of the feed air is not represented in the FIGURE. It can be performed by any known method, for example in a reversible heat exchanger (Revex) or in one or more molecular sieve units. In the latter case it is possible to subject all the feed air (line 3) to purification.

In the embodiment, the mass transfer elements in the preliminary separation column are distillation plates, those in the low-pressure column structured packing. But basically, conventional distillation plates, random packing and/or structured packing can be used in the invention in each of the two columns. Combinations of various elements in one column are also possible. Because of the advantage of a small pressure loss, structured packings are preferred in all columns, especially in the low-pressure column. The latter adds to the energy-saving effect of the invention.

Bearing in mind that each column operates within a range of pressure, higher at the bottom of each, it is preferred when the pressure ranges are not overlapping that the difference between the maximum pressure of the column having the lower average pressure and the minimum pressure of the column having the higher average pressure is lower than 0.5 bar, preferably lower than 0.1 bar. Likewise or alternatively, the pressure differences are preferably measured at the junction points of pipes connecting the columns, each temperature difference being less than 0.5 bar, preferably lower than 0.1 bar. The pressure difference recited in the claims is intended to cover all possibilities.

The preceding examples can be repeated with similar success by substituting the generically or specifically described reactants and/or operating conditions of this invention for those used in the preceding examples.

The entire disclosure of all applications, patents and publications, cited above and below, and of corresponding German application 19543395.5, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed:

1. A process for the low-temperature separation of air in a rectifying column system comprising a preliminary separation column (10) and a low-pressure column (20), said process comprising introducing feed air (1, 3) into said preliminary separation column (10), withdrawing a nitrogen-enriched fraction and an oxygen-enriched bottom fraction from said preliminary separation column (10), introducing at least a portion (19) of the oxygen-enriched bottom fraction into the low-pressure column (20), and withdrawing liquid oxygen and gaseous nitrogen in said low-pressure column (20), characterized in that the pressure in preliminary separation column (10) is essentially equal to the pressure in low-pressure column (20).

2. A process according to claim 1, wherein the difference between the pressure of the preliminary separation column and the low pressure column is less than 0.5 bar.

3. A process according to claim 1, wherein the difference between the pressure of the preliminary separation column and the low pressure column is less than 0.1 bar.

4. A process according to claim 1, wherein at least a portion of the nitrogen-enriched fraction (11) from the preliminary separation column (10) is heated (9, 5), compressed (13), liquefied by indirect heat exchange (16) and fed back (17, 18) into the rectifying column system.

5. A process according to claim 4, wherein the liquefied nitrogen-enriched fraction is fed back into the preliminary separation column (10).

6. A process according to claim 4, wherein at least a portion of the oxygen-enriched bottom fraction evaporates during indirect heat exchange (16) to liquefy nitrogenen-riched top fraction (15).

7. A process according to claim 1, wherein at least a portion of gaseous nitrogen (23) from low pressure column (20) is heated (24, 5), compressed (26), liquefied by indirect heat exchange (29) and fed back (30, 31) into the rectifying column system, in particular.

8. A process according to claim 7, wherein the liquefied gaseous nitrogen is fed back (30, 31) into the low pressure column (20).

9. A process according to claim 7, wherein at least a portion of the liquid oxygen evaporates during the indirect heat exchange (29) to liquefy gaseous nitrogen (28).

10. A process according to claim 1, wherein a portion (36, 39) of feed air (1, 3) is expanded (40) to produce energy and then is introduced into preliminary separation column (10) and/or into low-pressure column (41).

11. A process according to claim 10, wherein a portion (36) of the feed air to be expanded to produce energy is further compressed (37, 38) upstream from the energy-producing expansion (40).

12. A process according to claim 11, wherein energy produced during the energy-producing expansion (40) is used for further compressing (38) a portion (36) of the feed air to be expanded to produce energy.

13. An apparatus for the low-temperature separation of air comprising a rectifying column system having a preliminary separation column (10) and a low-pressure column (20), a feed air conduit (1, 3, 4, 6, 7, 8, 41) leading into said into preliminary separation column (10), a bottom fraction conduit (19, 21) connecting preliminary separation column (10) to said low-pressure column (20), wherein said bottom fraction conduit (19, 21) has no pressure-reducing devices.

14. An apparatus according to claim 13, further comprising a first recycle line connected to the upper section of preliminary separation column (10) and leading, by a heat exchanger (9, 5), a compressor (13) and through the liquefaction side of a first condenser-evaporator (16), back into the rectifying column system, in particular into preliminary separation column (10).

15. An apparatus according to claim 14, further comprising a second recycle line connected (23) to the upper section of low-pressure column (20) and leading, via a heat exchanger (24, 5), a compressor (26) and through the liquefaction side of a second condenser-evaporator (29), back into the rectifying column system, in particular into low-pressure column (20).

16. An apparatus according to claim 15, wherein the evaporation side of the second condenser-evaporator (29) is connected to the lower part of the low-pressure column (20).

17. An apparatus according to claim 14, wherein the evaporation side of the first condenser-evaporator (16) is connected to the lower part of the preliminary separation column (10).

18. An apparatus according to claim 13, further comprising a second recycle line connected (23) to the upper section of low-pressure column (20) and leading, via a heat exchanger (24, 5), a compressor (26) and through the liquefaction side of a second condenser-evaporator (29), back into the rectifying column system, in particular into low-pressure column (20).

19. An apparatus according to claim 17, wherein the evaporation side of the second condenser-evaporator (29) is connected to the lower part of the low-pressure column (20).

* * * * *